US006774713B2

(12) United States Patent
Watanabe

(10) Patent No.: US 6,774,713 B2
(45) Date of Patent: Aug. 10, 2004

(54) CIRCUIT FOR PRODUCING A REFERENCE VOLTAGE FOR TRANSISTORS SET TO A STANDBY STATE

(75) Inventor: Hajime Watanabe, Tokyo (JP)

(73) Assignee: Renesas Technology Corp., Tokyo (JP)

( * ) Notice: Subject to any disclaimer, the term of this patent is extended or adjusted under 35 U.S.C. 154(b) by 0 days.

(21) Appl. No.: 10/352,172

(22) Filed: Jan. 28, 2003

(65) Prior Publication Data

US 2004/0021505 A1 Feb. 5, 2004

(30) Foreign Application Priority Data

Jul. 30, 2002 (JP) ..... 2002-221694

(51) Int. Cl.[7] ..... G05F 1/10
(52) U.S. Cl. ..... 327/540
(58) Field of Search ..... 327/378, 512, 327/513, 530, 534, 535, 537, 538, 540, 541, 543

(56) References Cited

U.S. PATENT DOCUMENTS 5,691,661 A * 11/1997 Fukuda et al. ..... 327/172
6,326,837 B1 * 12/2001 Matano ..... 327/545
6,466,081 B1 * 10/2002 Eker ..... 327/541
6,529,563 B1 * 3/2003 Mosinskis et al. ..... 375/317
6,661,279 B2 * 12/2003 Yabe ..... 327/546

FOREIGN PATENT DOCUMENTS

JP 06-326587 11/1994
JP 11-003132 A 1/1999

* cited by examiner

*Primary Examiner*—Jeffrey Zweizig
(74) *Attorney, Agent, or Firm*—Burns, Doane, Swecker & Mathis, L.L.P.

(57) ABSTRACT

A leak monitoring transistor is selected from transistors of a semiconductor integrated circuit manufactured in the manufacturing process set to the same condition, and a reference voltage is produced in a reference voltage producing unit according to leak current of the leak monitoring transistor in a standby time period. The reference voltage is lowered as a value of the leak current is increased. An output voltage set to be equal to the reference voltage in an operational amplifier is applied to the other transistors of the semiconductor integrated circuit. The characteristic of the leak currents of the other transistors is the same as that of the leak monitoring transistor. Therefore, when the transistors having the leak currents higher than a designed value are manufactured, the output voltage is lowered due to the leak monitoring transistor having the leak current higher than the designed value.

14 Claims, 6 Drawing Sheets

CIRCUIT FOR PRODUCING A REFERENCE VOLTAGE FOR TRANSISTORS SET TO A STANDBY STATE

BACKGROUND OF THE INVENTION

1. Field of the Invention

The present invention relates to a reference voltage producing circuit in which a reference voltage is produced so as to reduce electric power consumed during a standby time period of transistors.

2. Description of Related Art

A large number of transistors manufactured according to prescribed functional specifications are arranged in a semiconductor integrated circuit. However, because conditions of the manufacturing process of transistors are undesirably changed, a threshold value Vth of voltage relating to both the on state and the off state or a channel length in each transistor is not accurately set to a designed value. Therefore, there is a case where transistors manufactured according to the same functional specification have different threshold values Vth of voltage and channel lengths.

For example, the threshold value Vth of voltage in a transistor actually manufactured is lower than a designed value, or the channel length in a transistor actually manufactured is shorter than a designed value. In this case, leak current of the transistor in a standby time period is undesirably heightened. Therefore, electric power consumed in a semiconductor integrated circuit having transistors in a standby time period is undesirably heightened more than a designed consumed electric power, a backup time of the semiconductor integrated circuit determined by a battery is shortened, and data stored in the transistors of the semiconductor integrated circuit is undesirably lost. To prevent this problem, transistors manufactured so as to have high leak current in a standby time period are normally discarded as defective transistors.

Here, a power management device is disclosed in Published Unexamined Japanese Patent Application No. H11-3132 (1999) as a conventional reference voltage producing circuit. In this device, voltage of a power source is controlled according to an operating frequency. However, in this device, leak current of no transistor in a standby time period is reduced while considering a difference between characteristics of the actually manufactured transistor and designed characteristics.

As is described above, the conventional reference voltage producing circuit is manufactured not to reduce leak current in a standby time period. Therefore, when the operating frequency of the conventional reference voltage producing circuit is lowered, voltage of the power source is lowered, and the conventional reference voltage producing circuit is operated while lowering the consumed electric power. However, in cases where transistors manufactured so as to have high leak current in a standby time period are arranged in a semiconductor integrated circuit, there is a problem that electric power consumed in the semiconductor integrated circuit cannot be reduced by using the conventional reference voltage producing circuit.

SUMMARY OF THE INVENTION

An object of the present invention is to provide, with due consideration to the drawbacks of the conventional reference voltage producing circuit, a reference voltage producing circuit which appropriately reduces electric power consumed in transistors of a semiconductor integrated circuit in a standby time period of the transistors even though the transistors are manufactured so as to have high leak current in a standby time period.

The object is achieved by the provision of a reference voltage producing circuit including reference voltage producing means, current supplying means and voltage control means. A reference voltage is produced by the reference voltage producing means according to leak current of a leak monitoring transistor in a standby time period, and an output voltage corresponding to the reference voltage by the voltage control means is applied to a semiconductor integrated circuit by the current supplying means.

Therefore, the output voltage applied to the semiconductor integrated circuit can be adjusted according to the leak current of the leak monitoring transistor in a standby time period. Accordingly, even though transistors are manufactured so as to have high leak current in a standby time period, electric power consumed in the semiconductor integrated circuit having the transistors can be appropriately reduced in a standby time period of the semiconductor integrated circuit.

DETAILED DESCRIPTION OF THE PREFERRED EMBODIMENTS

Embodiments of the present invention will now be described with reference to the accompanying drawings.

Embodiment 1

In general, a large number of transistors (for example, NMOS transistors or PMOS transistors) are simultaneously manufactured as a lot of transistors for each batch of the transistor manufacturing. Therefore, transistors of each lot are manufactured in the same condition of the manufacturing process. Also, all transistors arranged in each semiconductor integrated circuit are manufactured in the same batch. Therefore, all transistors arranged in each semiconductor integrated circuit are manufactured on the same condition of the manufacturing process. For example, in cases where leak current of one transistor of a semiconductor integrated circuit in a standby time period is higher (or lower) than a designed value by a certain degree, leak current of the other transistors of the semiconductor integrated circuit in a standby time period is also higher (or lower) than the designed value by the same degree.

In first, second, third, sixth and seventh embodiments, one transistor is arbitrarily selected from transistors of a semiconductor integrated circuit having the same characteristic of leak current as each other, and a voltage Vdd applied to the other transistors is set by the function of a reference voltage producing circuit using the selected transistor so as to appropriately reduce electric power consumed in the transistors of the semiconductor integrated circuit in a standby time period even though the actual leak current characteristic of the transistors in a standby time period differs from the designed leak current characteristic.

Figure 1:
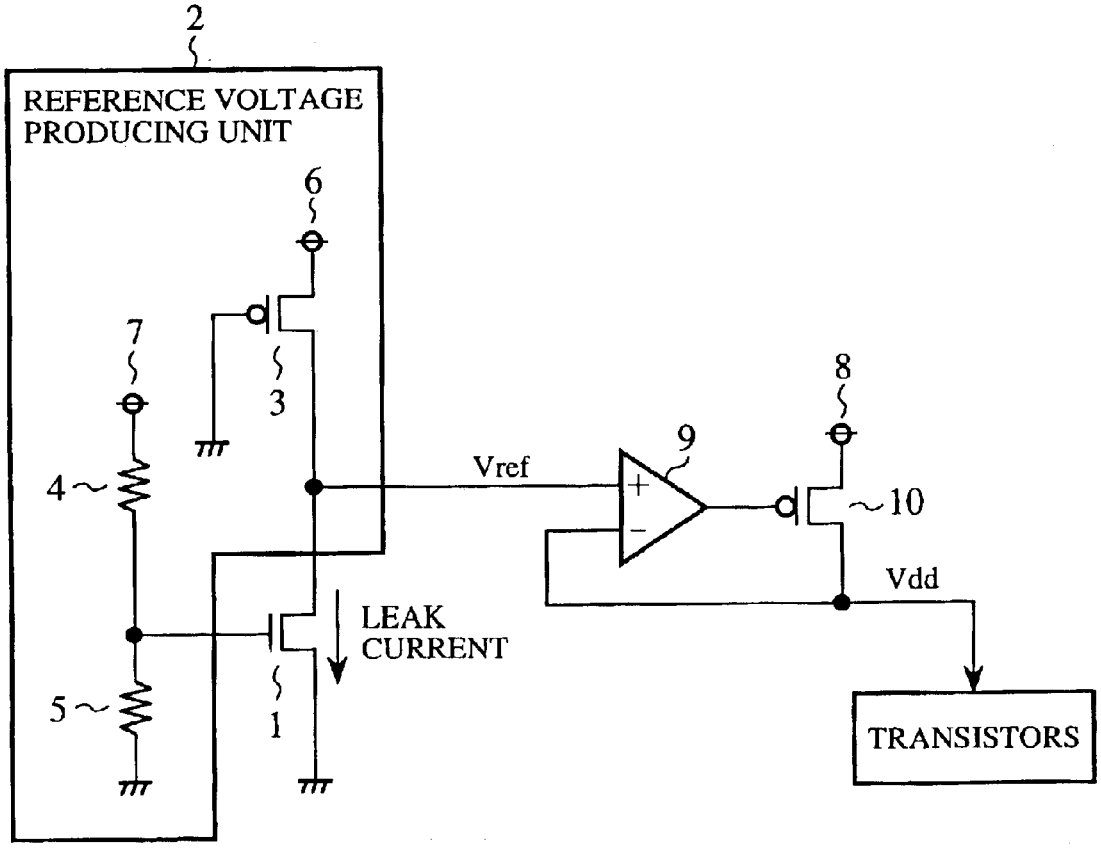
FIG. 1 is a constitutional view of a reference voltage producing circuit according to a first embodiment of the present invention.

FIG. 1 is a constitutional view of a reference voltage producing circuit according to a first embodiment of the present invention.

In FIG. 1, 1 indicates a leak monitoring transistor formed of an n-channel metal oxide semiconductor (NMOS) transistor. The leak monitoring transistor 1 is arbitrarily selected from a plurality of transistors arranged in a semiconductor integrated circuit. Leak current flows through the leak monitoring transistor 1 during a standby time period of the semiconductor integrated circuit. 2 indicates a reference voltage producing unit (or reference voltage producing means) for producing a reference voltage Vref according to the leak current of the leak monitoring transistor 1. 8 indicates a power source. 10 indicates a driver transistor (or current supplying means) for supplying current from the power source 8 to the other transistors of the semiconductor integrated circuit. The driver transistor 10 is formed of a p-channel metal oxide semiconductor (PMOS) transistor. 9 indicates an operational amplifier (or voltage control means) for controlling the driver transistor 10 so as to set an output voltage Vdd of the driver transistor 10 to the reference voltage Vref produced in the reference voltage producing unit 2.

In the reference voltage producing unit 2, 6 and 7 indicate power sources respectively. 3 indicates a PMOS transistor through which current is supplied from the power source 6 to the leak monitoring transistor 1 while applying the reference voltage Vref to the operational amplifier 9. A gate of the PMOS transistor 3 is grounded to fix a resistance value of the PMOS transistor 3. 4 and 5 respectively indicate resistors (or a divided voltage producing circuit) of which resistance values are changed in dependence on temperature. A voltage depending on the temperature of the resistors 4 and 5 is applied from the power source 7 to a gate of the leak monitoring transistor 1 through a connection terminal of the resistors 4 and 5.

Next, an operation of the reference voltage producing circuit will be described below.

One of transistors composing a semiconductor integrated circuit is arbitrarily selected as a leak monitoring transistor 1. When the semiconductor integrated circuit is set to a standby state, the transistors of the semiconductor integrated circuit including the leak monitoring transistor 1 are also set to the standby state, and leak current flows from the power source 6 to the ground through the PMOS transistor 3 and the leak monitoring transistor 1 during a standby time period. In this case, the value of the leak current flowing through the leak monitoring transistor 1 is determined according to a resistance value of the transistor 1 and a fixed resistance value of the PMOS transistor 3, and the reference voltage Vref at a drain connection point of the transistors 1 and 3 is determined according to both the fixed resistance value of the transistor 3 and the value of the leak current.

In cases where a chip temperature of the semiconductor integrated circuit is constant, the resistance values of the resistors 4 and 5 are fixed, the divided voltage applied to the gate of the leak monitoring transistor 1 is fixed, and the leak monitoring transistor 1 has a fixed resistance value. Therefore, the value of the leak current is fixed, and the reference voltage Vref depending on the value of the leak current is applied to a plus terminal of the operational amplifier 9.

In the operational amplifier 9, an output voltage Vdd of the driver transistor 10 is input to a minus terminal, and the driver transistor 10 is controlled to set the value of the output voltage Vdd to the value of the reference voltage Vref. Therefore, the output voltage Vdd having the same value as that of the reference voltage Vref is applied to the transistors of the semiconductor integrated circuit other than the leak monitoring transistor 1, and the value of the output voltage Vdd depends on the value of the leak current.

The resistance values of the resistors 4 and 5 and the resistance value of the transistor 3 are determined so as to set the reference voltage Vref to a specific value at which electric power consumed in the transistors of the semiconductor integrated circuit as leak current during the standby time period is appropriately set when the characteristic of leak current of the leak monitoring transistor 1 agrees with the designed characteristic of leak current.

Therefore, in cases where the transistors of the semiconductor integrated circuit are manufactured so as to heighten values of the leak current of the transistors for the reference voltage Vref of the specific value as compared with transistors having the designed leak current characteristic, the leak current of the leak monitoring transistor 1 actually manufactured is also heightened as compared with that of the leak monitoring transistor 1 having the designed characteristic. In this case, because a voltage drop in the PMOS transistor 3 is increased due to the increase of the leak current, the reference voltage Vref is lowered, and the output voltage Vdd of the driver transistor 10 is lowered. Therefore, because the output voltage Vdd lower than the specific value is applied to the other transistors having the heightened values of the leak current in the semiconductor integrated circuit, the leak current of the transistors of the semiconductor integrated circuit in the standby time period is reduced so as to appropriately reduce electric power consumed in the transistors of the semiconductor integrated circuit.

Also, in cases where the transistors of the semiconductor integrated circuit are manufactured so as to lower the leak current of the transistors, the leak current of the leak monitoring transistor 1 actually manufactured is also lowered. In this case, because a voltage drop in the PMOS transistor 3 is decreased, the reference voltage Vref is heightened, and the output voltage Vdd of the driver transistor 10 is heightened. Therefore, because the output voltage Vdd set to the value higher than the specific value is applied to the other transistors of the semiconductor integrated circuit, electric power consumed in the transistors of the semiconductor integrated circuit in a standby time period are appropriately set.

As is described above, in the first embodiment, the leak monitoring transistor 1 is arbitrarily selected from the transistors of the semiconductor integrated circuit, the reference voltage producing unit 2 is arranged so as to produce the reference voltage Vref depending on the leak current of the leak monitoring transistor 1 in a standby time period, and the operational amplifier 9 is arranged so as to set the output voltage Vdd of the driver transistor 10 to the reference voltage Vref. Therefore, when the transistors of the semiconductor integrated circuit are manufactured so as to heighten the leak current of the transistors, the leak current of the leak monitoring transistor 1 is also heightened, the output voltage Vdd applied to the transistors of the semiconductor integrated circuit other than the leak monitoring transistor 1 is set to be lowered, and the leak current of the transistors of the semiconductor integrated circuit can be appropriately reduced in a standby time period of the transistors. Also, when the transistors of the semiconductor integrated circuit are manufactured so as to lower the leak current of the transistors, the leak current of the leak monitoring transistor 1 is also lowered, the output voltage Vdd applied to the transistors of the semiconductor integrated circuit other than the leak monitoring transistor 1 is set to be heightened, and the leak current of the transistors of the semiconductor integrated circuit can be appropriately set in a standby time period of the transistors.

Accordingly, even though the transistors of the semiconductor integrated circuit are manufactured so as to heighten the leak current of the transistors, the electric power consumed in the transistors of the semiconductor integrated circuit can be appropriately reduced in a standby time period of the transistors.

In this embodiment, the output voltage Vdd is set by the operational amplifier 9 so as to have the voltage value agreeing with that of the reference voltage Vref. However, it is applicable that the voltage value of the output voltage Vdd corresponds to that of the reference voltage Vref on condition that the value of the output voltage Vdd depends on the value of the leak current.

Embodiment 2

In the first embodiment, the chip temperature of the semiconductor integrated circuit is set to be constant. In contrast, in a second embodiment, the chip temperature of the semiconductor integrated circuit is fluctuated.

In general, when temperature of a transistor is heightened, a leak current of the transistor in a standby time period is also heightened. To fix the leak current of the transistors of the semiconductor integrated circuit regardless of the fluctuation of the chip temperature of the semiconductor integrated circuit, the resistors 4 and 5 having the resistance values changed in dependent on temperature are arranged in the reference voltage producing unit 2.

When the chip temperature of the semiconductor integrated circuit is heightened, the resistance values of the resistors 4 and 5 are changed to heighten the gate voltage of the leak monitoring transistor 1, the leak monitoring transistor 1 is further turned on so as to lower the resistance value of the leak monitoring transistor 1, the leak current of the leak monitoring transistor 1 is increased, the voltage drop of the transistor 3 is heightened, the reference voltage Vref is lowered, and the output voltage Vdd applied to the transistors of the semiconductor integrated circuit is lowered. Therefore, regardless of the heightening of the chip temperature of the semiconductor integrated circuit, the leak current of the transistors of the semiconductor integrated circuit in a standby time period is fixed.

In contrast, when the chip temperature of the semiconductor integrated circuit is lowered, the gate voltage of the leak monitoring transistor 1 is lowered, the leak current of the leak monitoring transistor 1 is decreased, the reference voltage Vref is heightened, and the output voltage Vdd applied to the transistors of the semiconductor integrated circuit is heightened. Therefore, regardless of the lowering of the chip temperature of the semiconductor integrated circuit, the leak current of the transistors of the semiconductor integrated circuit in a standby time period is fixed.

Accordingly, even though the chip temperature of the semiconductor integrated circuit is heightened, the increase of the electric power consumed in the transistors of the semiconductor integrated circuit in a standby time period of the transistors can be prevented. Also, even though the chip temperature of the semiconductor integrated circuit is fluctuated, the electric power consumed in the transistors of the semiconductor integrated circuit can be appropriately reduced in a standby time period of the transistors.

Embodiment 3

Figure 2:
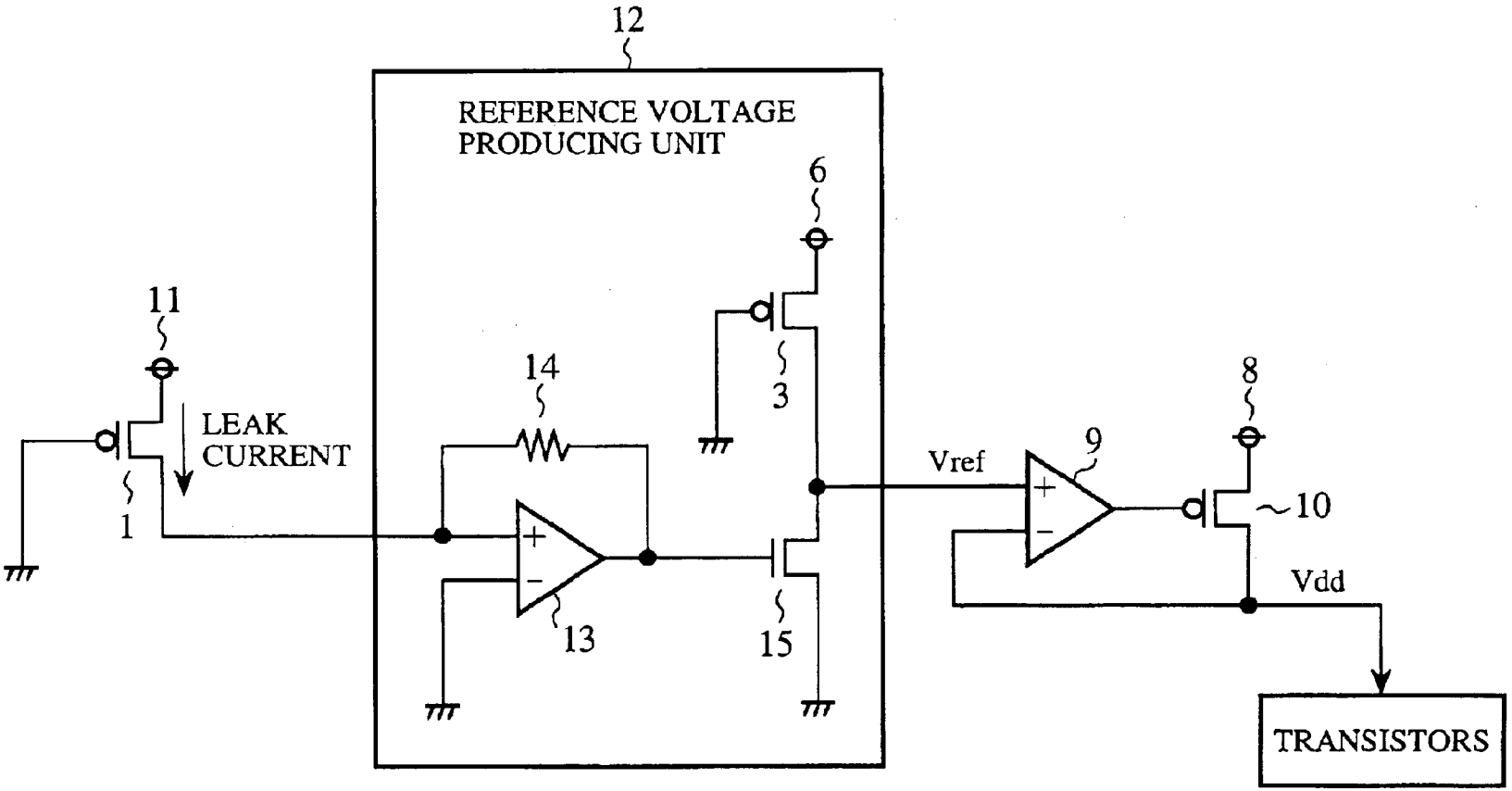
FIG. 2 is a constitutional view of a reference voltage producing circuit according to a third embodiment of the present invention.

FIG. 2 is a constitutional view of a reference voltage producing circuit according to a third embodiment of the present invention. The constituent elements, which are the same as those shown in FIG. 1, are indicated by the same reference numerals as those of the constituent elements shown in FIG. 1, and additional description of those constituent elements is omitted.

In FIG. 2, 11 indicates a power source of the leak current flowing through the leak monitoring transistor 1. 12 indicates a reference voltage producing circuit (or reference voltage producing means) for producing a constant value of the reference voltage Vref according to the leak current of the leak monitoring transistor 1 equal to or lower than a threshold current value and producing a leak current depending value of the reference voltage Vref lower than the constant value according to the leak current of the leak monitoring transistor 1 higher than the threshold current value.

In the reference voltage producing circuit 12, 15 indicates an NMOS transistor turned on when a gate voltage is higher than a threshold voltage value. When the gate voltage of the NMOS transistor 15 exceeds the threshold voltage value, the NMOS transistor 15 is gradually turned on as the gate voltage is increased. 13 indicates an operational amplifier for applying voltage to the gate of the NMOS transistor 15 as the gate voltage according to the leak current of the leak monitoring transistor 1 and heightening the gate voltage of the NMOS transistor 15 as the leak current of the leak monitoring transistor 1 is increased. 14 indicates a resistor. The reference voltage Vref at a drain connection point of the transistors 3 and 15 is applied to the operational amplifier 9.

Next, an operation of the reference voltage producing circuit will be described below.

One of transistors composing a semiconductor integrated circuit is arbitrarily selected as a leak monitoring transistor 1. When the semiconductor integrated circuit is set to a standby state, the transistors of the semiconductor integrated circuit including the leak monitoring transistor 1 are also set to the standby state, and a leak current flows from the power source 11 to the plus terminal of the operational amplifier 13 through the leak monitoring transistor 1 during a standby time period. In the operational amplifier 13, voltage corresponding to the value of the leak current of the leak monitoring transistor 1 is applied to the gate of the NMOS transistor 15.

In cases where the value of the leak current of the leak monitoring transistor 1 is equal to or lower than the threshold current value preset in the circuit design, voltage set to a value equal to or lower than the threshold voltage value is applied to the gate of the NMOS transistor 15, the NMOS transistor 15 is not turned on, and the reference voltage Vref having a constant value equal to the voltage of the power source 6 is applied to the plus terminal of the operational amplifier 9. Therefore, the output voltage Vdd set to the value agreeing with the constant value of the reference voltage Vref is applied to the other transistors of the semiconductor integrated circuit. In this case, the voltage of the power source 6 is preset to a designed voltage to be adequately applied to the transistors of the semiconductor integrated circuit in cases where the leak current of the transistors of the semiconductor integrated circuit actually manufactured is equal to or lower than a designed upper limit of leak current.

In contrast, in cases where the value of the leak current of the leak monitoring transistor 1 is higher than the threshold current value, voltage set to a value higher than the threshold voltage value is applied to the gate of the NMOS transistor 15, and the NMOS transistor 15 is turned on so as to produce a current flowing from the power source 6 to the ground through the transistors 3 and 15. Therefore, a reference voltage Vref set to a leak current depending value lower than the constant value is applied to the plus terminal of the operational amplifier 9, and the output voltage Vdd equal to the leak current depending value of the reference voltage Vref and lower than the constant value of the reference voltage Vref is applied to the other transistors of the semiconductor integrated circuit. Though the leak current of the other transistors of the semiconductor integrated circuit for the reference voltage Vref set to the constant value is larger than the designed upper limit of leak current, because the output voltage Vdd set to the value lower than the constant value of the reference voltage Vref is applied to the other transistors of the semiconductor integrated circuit, the leak current of the other transistors of the semiconductor integrated circuit in a standby time period is reduced to values equal to or lower than the designed upper limit of leak current.

Also, as the leak current of the leak monitoring transistor 1 is increased, the gate voltage of the NMOS transistor 15 is heightened, the turned-on degree of the NMOS transistor 15 is increased, the reference voltage Vref is lowered, and the output voltage Vdd applied to the other transistors of the semiconductor integrated circuit is lowered. Therefore, the reduction degree of the leak current of the other transistors of the semiconductor integrated circuit in a standby time period is appropriately adjusted according to the increase degree of the leak current of the leak monitoring transistor 1.

As is described above, in the third embodiment, the output voltage Vdd applied to the other transistors of the semiconductor integrated circuit is lowered as the leak current of the leak monitoring transistor 1 is increased. Therefore, electric power consumed in the other transistors of the semiconductor integrated circuit in a standby time period can be reduced to values equal to or lower than the designed upper limit of leak current. Also, the reduction degree of the electric power consumed in the other transistors of the semiconductor integrated circuit in a standby time period can be appropriately adjusted according to the increase degree of the leak current of the leak monitoring transistor 1.

Also, in cases where the leak current of the leak monitoring transistor 1 is equal to or lower than the threshold current value, the output voltage Vdd having a fixed value set in the circuit design can be applied to the other transistors of the semiconductor integrated circuit. Therefore, as compared with in the first embodiment, electric power consumed in the semiconductor integrated circuit in a standby time period can be maintained to a low value in cases where the transistors of the semiconductor integrated circuit are manufactured so as to lower the leak current in a standby time period.

Embodiment 4

Figure 3:
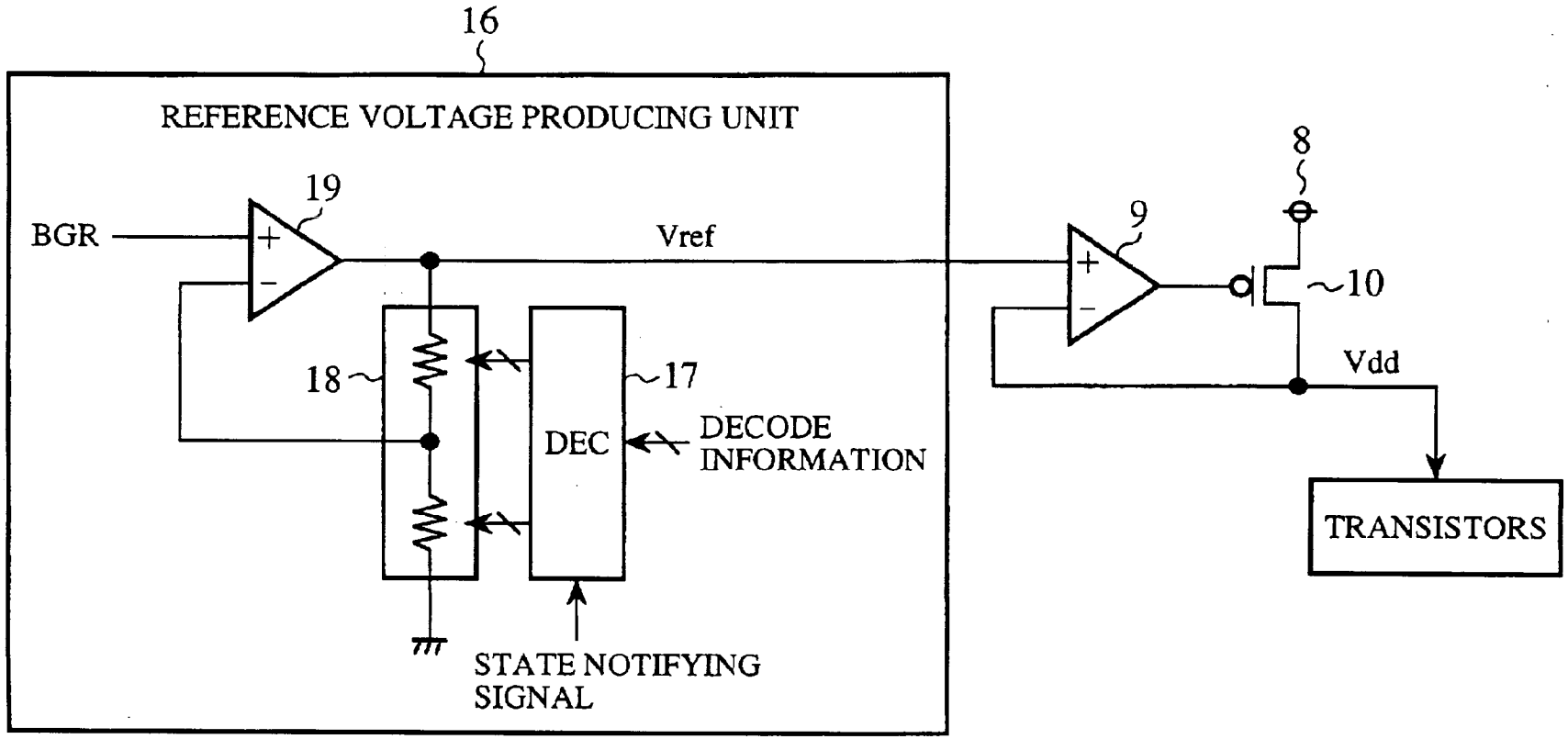
FIG. 3 is a constitutional view of a reference voltage producing circuit according to a fourth embodiment of the present invention.

FIG. 3 is a constitutional view of a reference voltage producing circuit according to a fourth embodiment of the present invention. The constituent elements, which are the same as those shown in FIG. 1, are indicated by the same reference numerals as those of the constituent elements shown in FIG. 1, and additional description of those constituent elements is omitted.

In FIG. 3, 16 indicates a reference voltage producing unit (or reference voltage producing means) for storing production information which indicates an optimum value of a reference voltage Vref corresponding to the appropriate leak current of transistors of a semiconductor integrated circuit set to a standby state, and producing the reference voltage Vref of the optimum value with reference to the production information of the reference voltage Vref when the transistors of the semiconductor integrated circuit are set to the standby state.

In the reference voltage producing unit 16, 17 indicates a decoder (DEC) for storing standby resistance values R2 of resistors of a voltage divider as the production information indicating the optimum value of the reference voltage Vref corresponding to the appropriate leak current of the transistors set in the standby state, outputting an initialization signal in response to a state notifying signal indicating that the transistors of the semiconductor integrated circuit are set in an operating state, and outputting a resistance instructing signal indicating the standby resistance values R2 in response to a state notifying signal indicating that the transistors of the semiconductor integrated circuit are set to a standby state. 18 indicates a voltage divider of which resistors are set to initial resistance values R1 according to the initialization signal output from the decoder 17 and are set to the standby resistance values R2 according to the resistance instructing signal output from the decoder 17. 19 indicates an operational amplifier for receiving a band gap reference (BGR) voltage denoting a reference voltage setting signal, receiving a divided voltage output from the voltage divider 18, outputting the reference voltage Vref set to an initial value according to the divided voltage of the voltage divider 18 set to the initial resistance values R1, and outputting the reference voltage Vref set to the optimum value lower than the initial value of the reference voltage Vref according to the divided voltage of the voltage divider 18 set to the standby resistance values R2.

A reference voltage producing circuit comprises the voltage divider 18 and the operational amplifier 19.

Next, an operation of the reference voltage producing circuit will be described below.

In an optimum reference voltage determining process, electric power consumed in the transistors of the semiconductor integrated circuit of a standby state is measured while the value of the reference voltage Vref output from the operational amplifier 19 is appropriately changed, and the reference voltage Vref of the optimum value corresponding to the appropriate leak current of the transistors of the semiconductor integrated circuit set to the standby state is determined. Thereafter, standby resistance values R2 of the resistors of the voltage divider 18 corresponding to the reference voltage Vref of the optimum value is stored in the decoder 17 as the production information indicating the reference voltage Vref of the optimum value.

In cases where a state notifying signal indicating that the transistors of the semiconductor integrated circuit are set in an operating state is received in the decoder 17, an initialization signal is output from the decoder 17 to the voltage divider 18, resistors of the voltage divider 18 are set to initial resistance values R1, the reference voltage Vref set to an initial value is output from the operational amplifier 19 according to the divided voltage of the voltage divider 18 set to the initial resistance values R1, and the output voltage Vdd equal to the initial value of the reference voltage Vref is applied to the transistors of the semiconductor integrated circuit in an operating time period. Therefore, the transistors of the semiconductor integrated circuit can be appropriately operated according to the output voltage Vdd.

In contrast, in cases where a state notifying signal indicating that the transistors of the semiconductor integrated circuit are set to a standby state is received in the decoder 17, a resistance instructing signal denoting the production information is output from the decoder 17 to the voltage divider 18, resistors of the voltage divider 18 are set to standby resistance values R2, the reference voltage Vref of an optimum value lower than the initial value of the reference voltage Vref is output from the operational amplifier 19 according to the divided voltage of the voltage divider 18 set to the standby resistance values R2, and the output voltage Vdd equal to the optimum value of the reference voltage Vref and lower than the initial value of the reference voltage Vref is applied to the transistors of the semiconductor integrated circuit in a standby time period. Therefore, the transistors of the semiconductor integrated circuit are set to the optimum leak current in a standby time period.

As is described above, in the fourth embodiment, the optimum value of the reference voltage Vref corresponding to the appropriate leak current of the transistors of the semiconductor integrated circuit set to a standby state is measured, and the output voltage Vdd equal to the optimum value of the reference voltage Vref is applied to the transistors of the semiconductor integrated circuit in a standby time period. Accordingly, electric power consumed in the transistors of the semiconductor integrated circuit in a standby time period can be reduced to values equal to or lower than the designed upper limit of leak current without using any leak monitoring transistor selected from the transistors.

Embodiment 5

Figure 4:
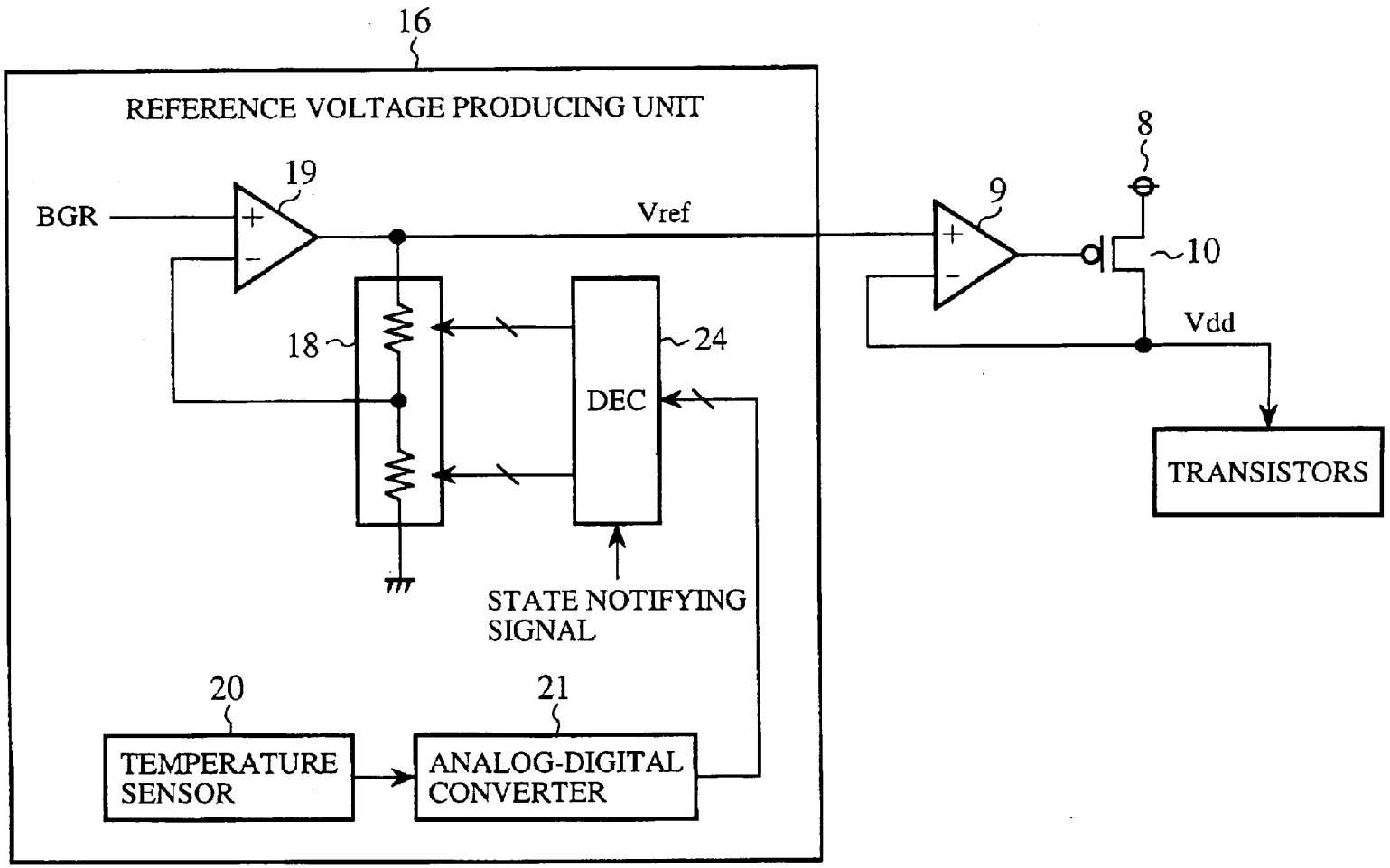
FIG. 4 is a constitutional view of a reference voltage producing circuit according to a fifth embodiment of the present invention.

FIG. 4 is a constitutional view of a reference voltage producing circuit according to a fifth embodiment of the present invention. The constituent elements, which are the same as those shown in FIG. 3, are indicated by the same reference numerals as those of the constituent elements shown in FIG. 3, and additional description of those constituent elements is omitted.

In FIG. 4, 20 indicates a temperature sensor for measuring a chip temperature of the semiconductor integrated circuit. 21 indicates an analog-digital converter for performing an analog-digital conversion for an analog value of the chip temperature measured in the temperature sensor 20. 24 indicates a decoder (or a production information selecting circuit) for storing standby resistance values R2 of resistors of the voltage divider 18 as production information, which indicates the optimum value of the reference voltage Vref corresponding to the appropriate leak current of the transistors depending on the chip temperature of the semiconductor integrated circuit in the standby state, for each value of the chip temperature, outputting an initialization signal in response to a state notifying signal indicating that the transistors of the semiconductor integrated circuit are set in an operating state, selecting one piece of production information corresponding to the chip temperature of the semiconductor integrated circuit detected by the temperature sensor 20 in response to a state notifying signal indicating that the transistors of the semiconductor integrated circuit are set to a standby state, and outputting a resistance instructing signal indicating the standby resistance values R2 of the selected production information.

Here, the temperature sensor 20 and the analog-digital conversion 21 are intermittently operated to set electric power consumed in both the temperature sensor 20 and the analog-digital conversion 21 as low as possible.

Next, an operation of the reference voltage producing circuit will be described below.

In the fourth embodiment, the optimum value of the reference voltage Vref corresponding to the appropriate leak current of the transistors of the semiconductor integrated circuit in a standby time period is determined without considering a chip temperature of the semiconductor integrated circuit, and the standby resistance values R2 of the resistors of the voltage divider 18 corresponding to the reference voltage Vref of the optimum value is stored in the decoder 24 as the production information indicating the reference voltage Vref of the optimum value.

In contrast, in a fifth embodiment, an optimum value of the reference voltage Vref corresponding to the appropriate leak current of the transistors of the semiconductor integrated circuit set to a standby state is determined while changing the chip temperature of the semiconductor integrated circuit, and standby resistance values R2 of the resistors of the voltage divider 18 corresponding to the optimum value of the reference voltage Vref is stored in advance in the decoder 24 as production information for each chip temperature. For example, the optimum value of the reference voltage Vref is lowered as the chip temperature of the semiconductor integrated circuit is increased.

Thereafter, in cases where a state notifying signal indicating that the transistors of the semiconductor integrated circuit are set to a standby state is received in the decoder 24, a value of the chip temperature measured in the temperature sensor 20 and digitized in the analog-digital converter 21 is received in the decoder 24, a resistance instructing signal indicating standby resistance values R2 corresponding to the chip temperature currently measured is output from the decoder 24 to the voltage divider 18, and resistors of the voltage divider 18 are set to the standby resistance values R2 corresponding to the chip temperature currently measured.

Accordingly, in the fifth embodiment, even though the chip temperature of the semiconductor integrated circuit is heightened, the increase of the electric power consumed in the transistors of the semiconductor integrated circuit in a standby time period can be prevented. Also, even though the chip temperature of the semiconductor integrated circuit is fluctuated, the electric power consumed in the transistors of the semiconductor integrated circuit can be appropriately set in a standby time period of the transistors.

Embodiment 6

Figure 5:
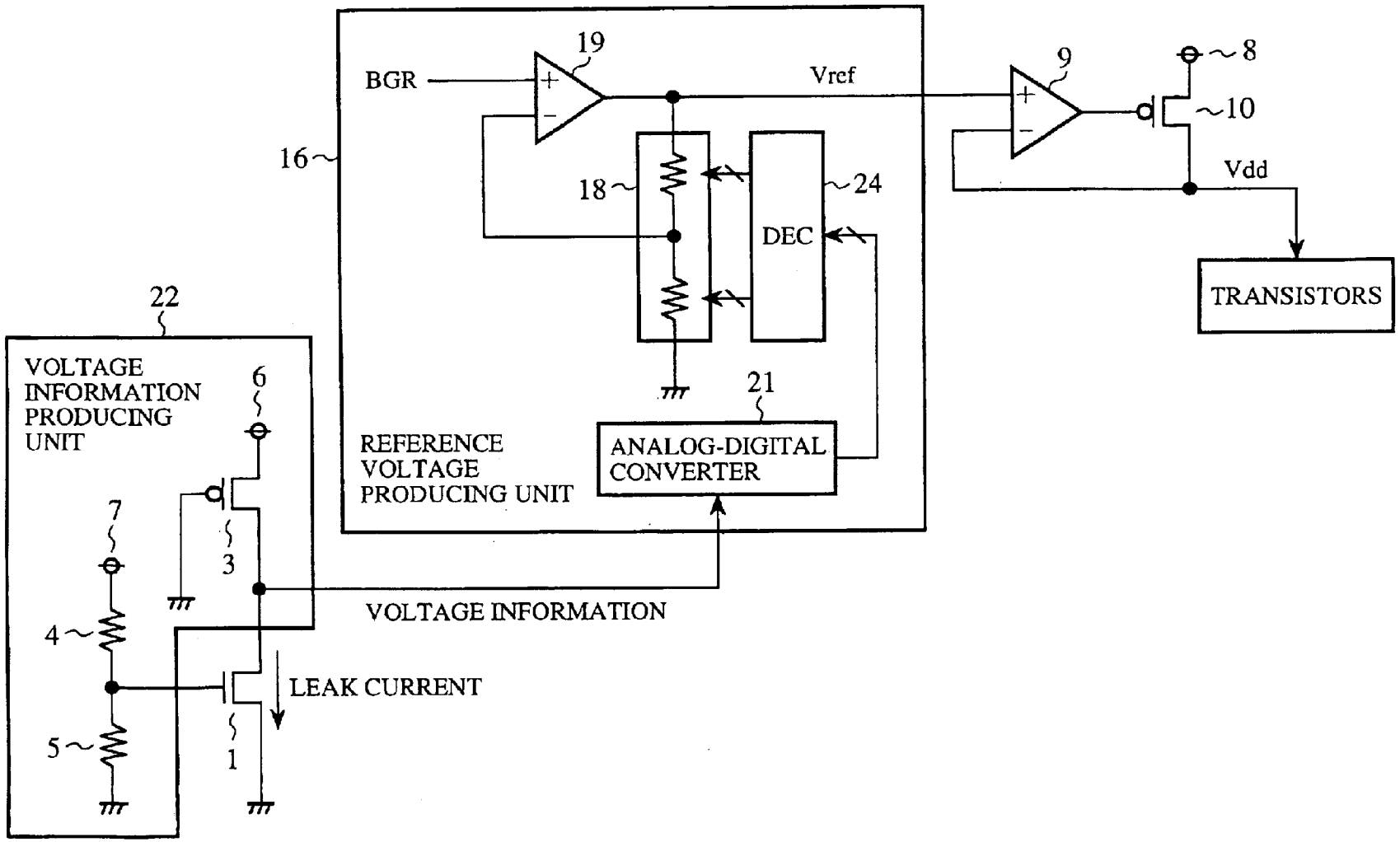
FIG. 5 is a constitutional view of a reference voltage producing circuit according to a sixth embodiment of the present invention.

FIG. 5 is a constitutional view of a reference voltage producing circuit according to a sixth embodiment of the present invention. The constituent elements, which are the same as those shown in FIG. 4, are indicated by the same reference numerals as those of the constituent elements shown in FIG. 4, and additional description of those constituent elements is omitted.

In FIG. 5, 22 indicates a voltage information producing unit (or voltage information producing means) for producing voltage information indicating a value of the reference voltage Vref corresponding to a value of the leak current of the leak monitoring transistor 1 in a standby time period. The voltage information producing unit 22 has the same configuration as that of the reference voltage producing unit 2.

Next, an operation of the reference voltage producing circuit will be described below.

In the fifth embodiment, the optimum value of the reference voltage Vref corresponding to the appropriate leak current of the transistors of the semiconductor integrated circuit in a standby time period is determined while changing the chip temperature of the semiconductor integrated circuit, and the standby resistance values R2 of the resistors of the voltage divider 18 corresponding to the reference voltage Vref of the optimum value is stored in advance in the decoder 24 as production information indicating the reference voltage Vref of the optimum value for each chip temperature.

In contrast, in a sixth embodiment, an optimum value of the reference voltage Vref corresponding to the appropriate leak current of a transistor set to a standby state is determined while changing the value of the leak current of the transistor, and standby resistance values R2 of the resistors of the voltage divider 18 corresponding to the reference voltage Vref of the optimum value is stored in advance in the decoder 24 as production information indicating the reference voltage Vref of the optimum value for each value of the leak current of the transistor.

Thereafter, in cases where a state notifying signal indicating that the transistors of the semiconductor integrated circuit are set to a standby state is received in the decoder 24, a value of the reference voltage Vref corresponding to a value of the leak current of the leak monitoring transistor 1 in a standby time period is obtained in the voltage information producing unit 22 in the same manner as in the reference voltage producing unit 2, voltage information indicating the value of the reference voltage Vref is output from the voltage information producing unit 22 to the decoder 24 of the reference voltage producing unit 16 through the analog-digital converter 21, the production information corresponding to the voltage information is selected in the decoder 24, and the resistance instructing signal indicating standby resistance values R2 corresponding to the selected production information is output from the decoder 24 to the voltage divider 18, and resistors of the voltage divider 18 are set to the standby resistance values R2.

As is described above, in the sixth embodiment, standby resistance values R2 of the resistors of the voltage divider 18 is stored in the decoder 24 for each value of the leak current, and resistors of the voltage divider 18 are set to the standby resistance values R2 corresponding to the value of the leak current of the leak monitoring resistor 1 in a standby time period. Accordingly, the transistors of the semiconductor integrated circuit can be set to the appropriate leak current, and the increase of the electric power consumed in the transistors of the semiconductor integrated circuit can be prevented.

Embodiment 7

Figure 6:
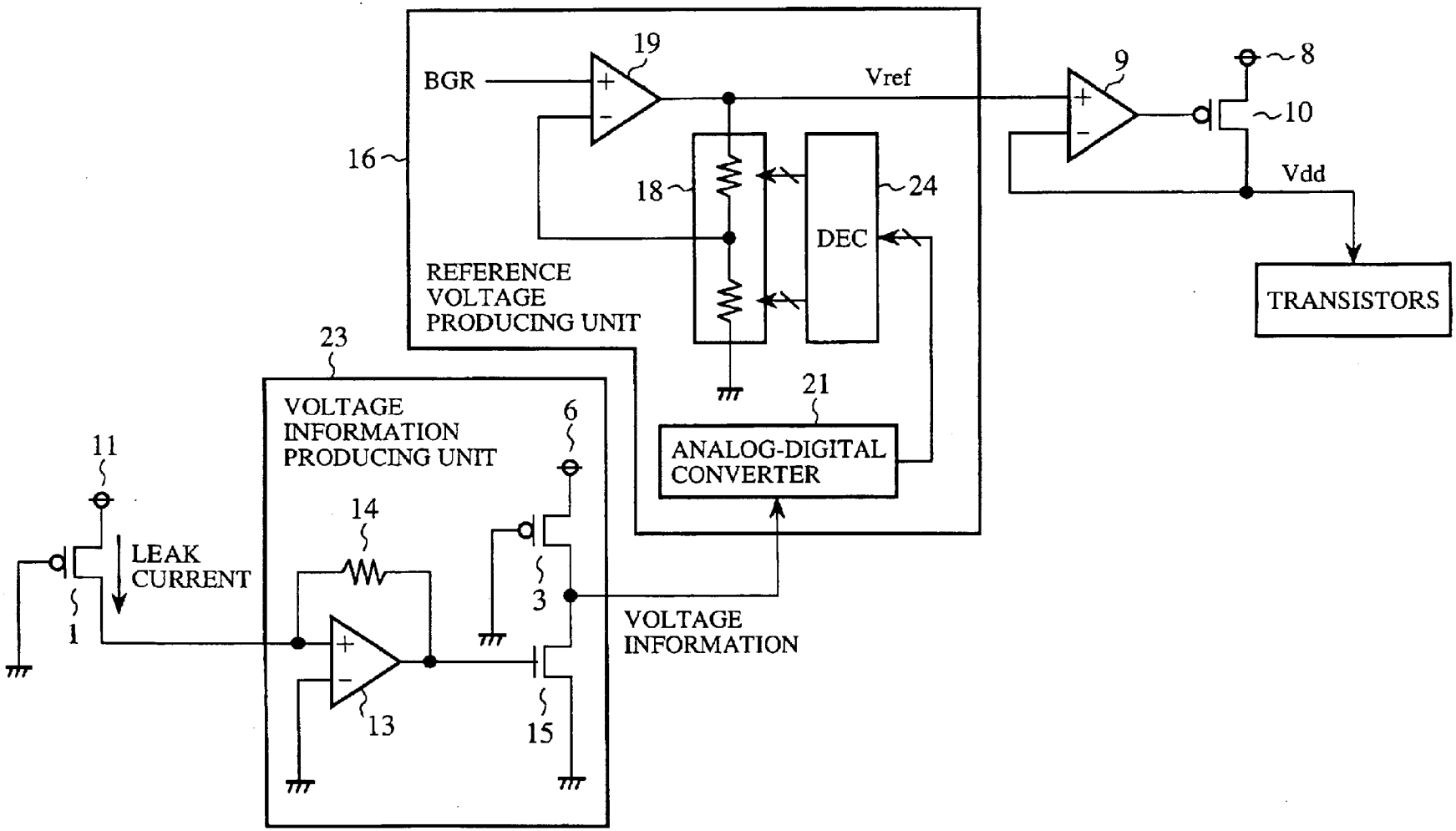
FIG. 6 is a constitutional view of a reference voltage producing circuit according to a seventh embodiment of the present invention.

FIG. 6 is a constitutional view of a reference voltage producing circuit according to a seventh embodiment of the present invention. The constituent elements, which are the same as those shown in FIG. 4, are indicated by the same reference numerals as those of the constituent elements shown in FIG. 4, and additional description of those constituent elements is omitted.

In the sixth embodiment, voltage information indicating a reference voltage Vref corresponding to a value of the leak current of the leak monitoring transistor 1 in a standby time period is output from the voltage information producing unit 22 equivalent to the reference voltage producing unit 2 to the reference voltage producing unit 16.

In contrast, in a seventh embodiment, voltage information indicating a reference voltage Vref corresponding to a value of the leak current of the leak monitoring transistor 1 in a standby time period is output from the voltage information producing unit 23 equivalent to the reference voltage producing unit 12 shown in FIG. 2 to the reference voltage producing unit 16.

Accordingly, the transistors of the semiconductor integrated circuit can be set to the appropriate leak current, and the increase of the electric power consumed in the transistors of the semiconductor integrated circuit can be prevented in the same manner as in the sixth embodiment.

What is claimed is:

1. A reference voltage producing circuit comprising:

reference voltage producing means for producing a reference voltage according to leak current of a leak monitoring transistor in a standby time period;

current supplying means for supplying current set to an output voltage to a semiconductor integrated circuit;

voltage control means for controlling the current supplying means to set the output voltage to a value corresponding to the reference voltage produced by the reference voltage producing means; and wherein the reference voltage produced by the reference voltage producing means is lowered as temperature of the semiconductor integrated circuit in the standby time period is heightened.

2. The reference voltage producing circuit according to claim 1, wherein the reference voltage producing means comprises a divided voltage producing circuit for producing a divided voltage depending on temperature of the divided voltage producing circuit and applying the divided voltage to a gate of the leak monitoring transistor to change the leak current of the leak monitoring transistor in dependent on the temperature of the divided voltage producing circuit.

3. The reference voltage producing circuit according to claim 1, wherein the reference voltage produced by the reference voltage producing means is equal to a maximum value in a case where the leak current of the leak monitoring transistor in the standby time period is equal to or lower than a threshold current value, and the reference voltage produced by the reference voltage producing means is lower than the maximum value in a case where the leak current of the leak monitoring transistor in the standby time period is higher than the threshold current value.

4. The reference voltage producing circuit according to claim 1, wherein the leak monitoring transistor is selected from a plurality of transistors of the semiconductor integrated circuit, and the output voltage of the current supplying means controlled by the voltage control means is applied to the other transistors of the semiconductor integrated circuit.

5. The reference voltage producing circuit according to claim 4, wherein the transistors of the semiconductor integrated circuit have the same characteristic of the leak current as each other.

6. The reference voltage producing circuit according to claim 1, wherein the reference voltage produced by the reference voltage producing means is lowered as the leak current of leak monitoring transistor is increased.

7. A reference voltage producing circuit comprising:

reference voltage producing means for storing production information of a reference voltage corresponding to a value of leak current of a transistor set to a standby state and producing the reference voltage according to the production information in a case where a plurality of transistors of a semiconductor integrated circuit is set to the standby state;

current supplying means for supplying current set to an output voltage to the transistors of the semiconductor integrated circuit; and voltage control means for controlling the current supplying means to set the output voltage to a value corresponding to the reference voltage produced by the reference voltage producing means.

8. The reference voltage producing circuit according to claim 7, wherein the reference voltage producing means comprises:

a temperature sensor for detecting a temperature of the semiconductor integrated circuit;

a production information selecting circuit for storing a plurality of pieces of temperature depending production information corresponding to a plurality of temperatures of the semiconductor integrated circuit set to the standby state as the production information and selecting one piece of temperature depending production information corresponding to the temperature detected by the temperature sensor; and a reference voltage producing circuit for producing the reference voltage corresponding to the temperature detected by the temperature sensor according to the piece of temperature depending production information selected by the production information selecting circuit.

9. The reference voltage producing circuit according to claim 7, wherein the transistors of the semiconductor integrated circuit have the same characteristic of the leak current as each other.

10. The reference voltage producing circuit according to claim 7, wherein the reference voltage produced by the reference voltage producing means is lowered as the value of the leak current of transistor is increased.

11. A reference voltage producing circuit comprising;

voltage information producing means for producing voltage information according to a value of leak current of a leak monitoring transistor in a standby time period;

reference voltage producing means for storing a value of a reference voltage corresponding to a value of leak current of a transistor set to a standby state for each value of the leak current and selecting a specific value of the reference voltage from the values of the reference voltage according to the voltage information produced by the voltage information producing means in a case where a semiconductor integrated circuit is set to the standby state;

current supplying means for supplying current set to an output voltage to the semiconductor integrated circuit; and voltage control means for controlling the current supplying means to set the output voltage to a value corresponding to the specific value of the reference voltage selected by the reference voltage producing means.

12. The reference voltage producing circuit according to claim 11, wherein the leak monitoring transistor is selected from a plurality of transistors of the semiconductor integrated circuit, and the output voltage of the current supplying means controlled by the voltage control means is applied to the other transistors of the semiconductor integrated circuit.

13. The reference voltage producing circuit according to claim 12, wherein the transistors of the semiconductor integrated circuit have the same characteristic of the leak current as each other.

14. The reference voltage producing circuit according to claim 11, wherein the specific value of the reference voltage produced by the reference voltage producing means is lowered as the value of the leak current of the leak monitoring transistor is increased.

* * * * *